US005159792A

United States Patent [19]

Pomento

[11] Patent Number: 5,159,792

[45] Date of Patent: Nov. 3, 1992

[54] ROOF TRUSS BUILDING

[76] Inventor: Patrick G. Pomento, 802 W. Embargo St., Rome, N.Y. 13440

[21] Appl. No.: 667,762

[22] Filed: Mar. 11, 1991

[51] Int. Cl.[5] ..... E04B 7/02

[52] U.S. Cl. ..... 52/93; 52/80; 52/86; 52/639; 52/642; 52/644

[58] Field of Search ..... 52/90, 91, 92, 93, 80, 52/86, 87, 639, 642, 644, 293, 294, 295, 299

[56] References Cited

U.S. PATENT DOCUMENTS

| | | | |
|---|---|---|---|
| 1,346,229 | 7/1920 | Mecham . | |
| 1,387,698 | 8/1921 | Erickson | 52/92 |
| 1,800,988 | 4/1931 | Ewing | 52/86 X |
| 2,288,193 | 7/1939 | Horn et al. . | |
| 2,385,142 | 9/1945 | Lank | 52/639 |
| 2,612,854 | 10/1952 | Fuge | 52/86 |
| 3,186,524 | 6/1965 | Spaeth, Jr. | 52/86 |
| 3,343,321 | 3/1967 | Axelsson . | |
| 3,346,999 | 9/1967 | Johnson . | |
| 3,501,876 | 3/1970 | Engle | 52/86 |
| 3,820,292 | 6/1974 | Fitzpatrick | 52/80 |
| 4,285,174 | 8/1981 | Knight | 52/81 |
| 4,312,160 | 1/1982 | Wilbanks | 52/92 |
| 4,412,405 | 11/1983 | Tucker | 52/86 |
| 4,483,117 | 6/1984 | Underhill et al. | 52/639 |
| 4,627,208 | 12/1986 | Esposito | 52/483 |
| 4,854,104 | 8/1989 | Pomento | 52/639 |
| 4,862,653 | 7/1989 | Pomento | 52/93 |
| 4,982,545 | 1/1991 | Stromback | 52/639 |

FOREIGN PATENT DOCUMENTS

| | | | |
|---|---|---|---|
| 689957 | 4/1953 | United Kingdom | 52/639 |
| 2177139 | 1/1987 | United Kingdom | 52/86 |

*Primary Examiner*—David A. Scherbel
*Assistant Examiner*—Kien Nguyen
*Attorney, Agent, or Firm*—Wall and Roehrig

[57] ABSTRACT

A building having a plurality of spaced apart concrete pilasters vertically disposed in the ground and having their tops in a common horizontal plane carry thereon a similar plurality of roof truss members which are generally vertically disposed on the pilasters and which join at the crown that leads to one other truss member to form a roof enclosure for a frame structure for a building. Truss members are covered with sheeting panels to enclose the building above the top of the pilasters and the barrier wall is provided from a series of panels mounted on the inside of the pilasters. The truss members are arranged to provide a triangular interior roof profile and a hip roof exterior profile eliminating the need for vertical wall sections on a circular building and on a rectangular, except for the end walls.

10 Claims, 8 Drawing Sheets

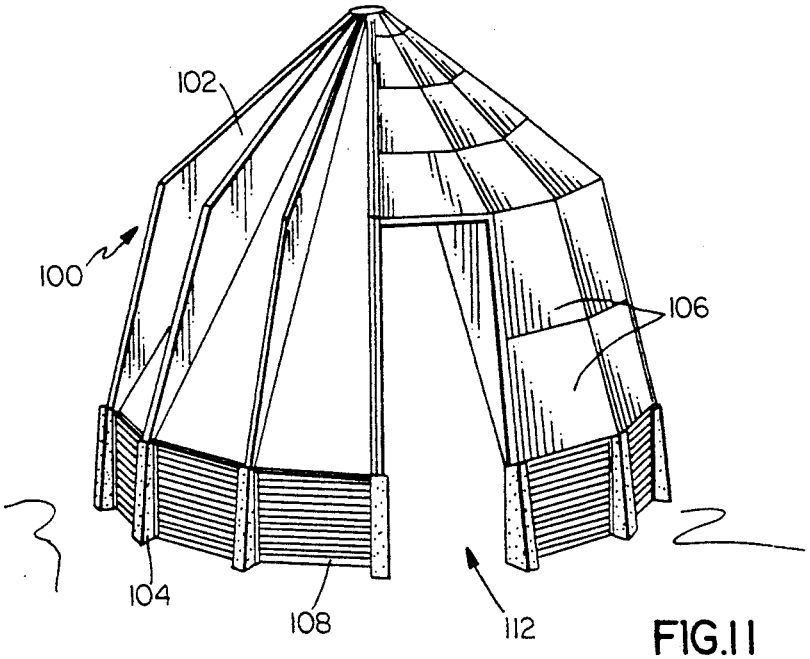
FIG.11
FIG.12
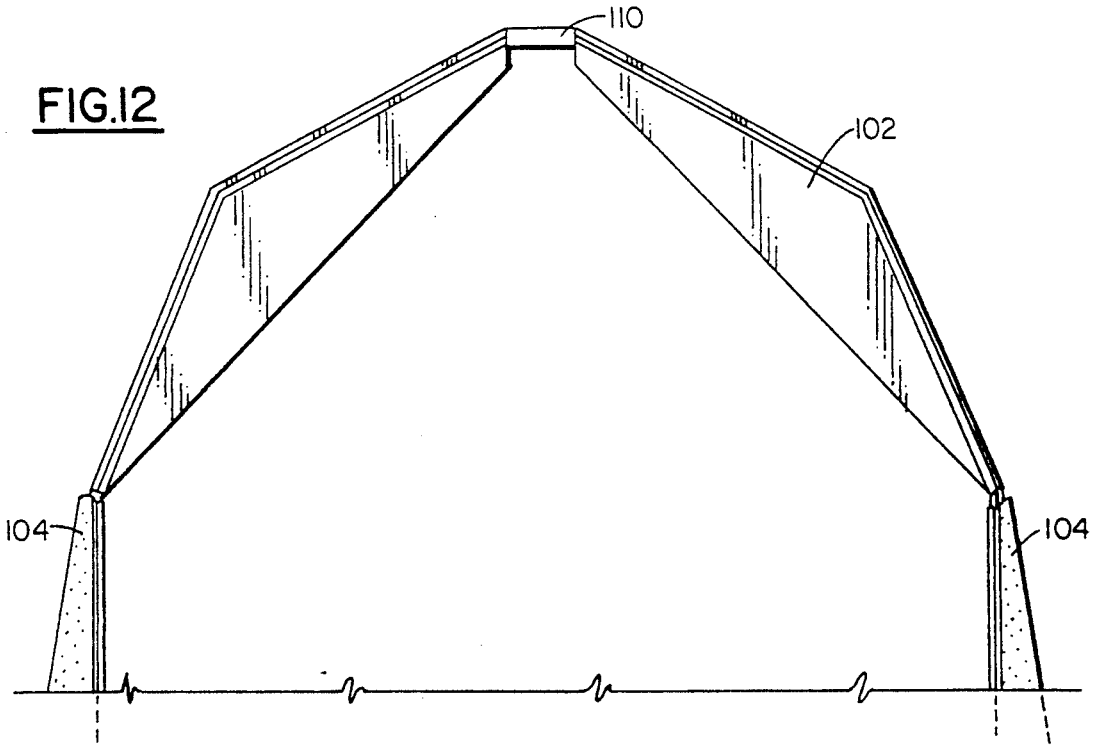

ROOF TRUSS BUILDING

BACKGROUND OF THE INVENTION

This invention relates to a building structure and more particularly to a building having virtually no side wall that can be quickly assembled from premanufactured wooden:truss components in an economical fashion. Buildings of this type are ideally suited for storing particulate material.

In my U.S. Pat. Nos. 4,862,653 and 4,854,104, I have disclosed buildings of this general type and a combination side wall/roof truss member ideally suited for factory fabrication and easy site assembly for buildings where a side wall and a peaked roof are required. These structures, while providing substantial improvements over the prior art have required careful site assembly of the premanufactured wall and roof components forming the truss and require the use of building siding material for the vertical portions of the wooden truss structure.

SUMMARY OF THE INVENTION

It is therefore an object of the present invention to provide an improved building structure for use in storing particulate materials.

It is another object of the present invention to provide a building structure that requires minimal side wall facing material.

It is yet another object of the present invention to provide a building structure that can be enclosed with roof trusses and roof panels mounted thereon.

It is still a further object of the present invention to provide a building structure utilizing roof trusses that can be completely preassembled in a factory, for erection at the site without further assembly operations.

It is yet a further object of the present invention to provide a building structure and wooden roof truss that is more economical to manufacture and erect.

It is a still further object of the present invention to provide a building structure and wooden truss construction that allows greater spans with lighter yet stronger truss members that can be completely fabricated in a factory and easily assembled on the job site.

These and other and further objects of the present invention are attained by means of a building that includes a plurality of spaced apart pilasters vertically fixed in the ground with the upper ends at a given elevation lying in a common horizontal plane. A barrier wall, if required, is erected on the inside of the pilasters using heavy beam members and wooden truss members are seated on top of the pilasters with the truss members extending from the top of the vertically disposed pilaster to a roof peak where it is attached to at least one other truss member mounted on another pilaster. The truss members are covered with sheeting panels to enclose the building above the top of the barrier wall, if any.

In one form of the invention the building is rectangular in form and has an oversized entrance in the front wall to permit dump trucks and other similar types of mobile loading and unloading equipment to move freely into and out of the building. A vertical back wall is provided to complete the enclosure of the building. The pilasters extend vertically upward some ten to fifteen feet and a heavy barrier wall is placed on the inside of the pilasters to protect the pilasters and the building structure from damage from equipment operating inside the building. Also the barrier wall is constructed of members capable of resisting the weight of the particulate material to be stored in the building and preferably is formed of material that will not readily deteriorate when placed in contact with material such as road salt, wet sand and the like.

BRIEF DESCRIPTION OF THE DRAWINGS

For a better understanding of these and other objects of the present invention, reference is made to the detailed description of the invention which is to be read in conjunction with the following drawings, wherein:

FIG. 11 is perspective view of another building embodying the teachings of the present invention;

FIG. 12 is a cross-sectional view taken through opposed truss members and pilasters showing the positioning of the truss members in FIG. 11;

DETAILED DESCRIPTION OF A PREFERRED EMBODIMENT

Figure 1:
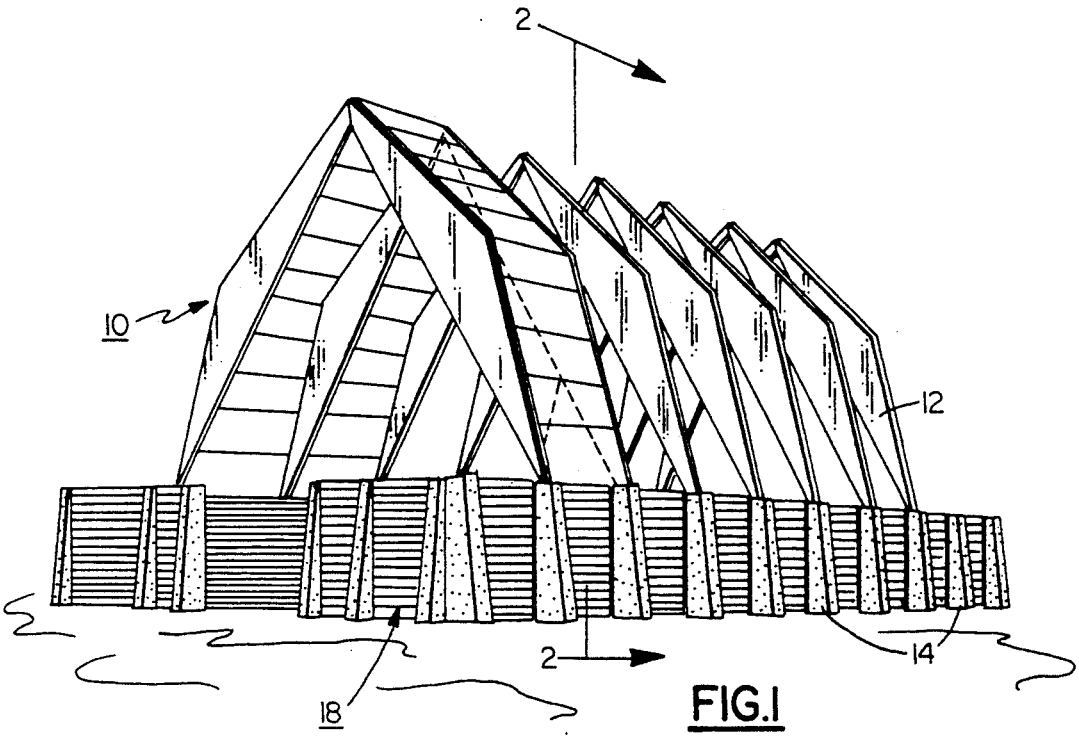
FIG. 1 is a perspective view of a building incorporating truss members embodying the teachings of the present invention.
Figure 10:
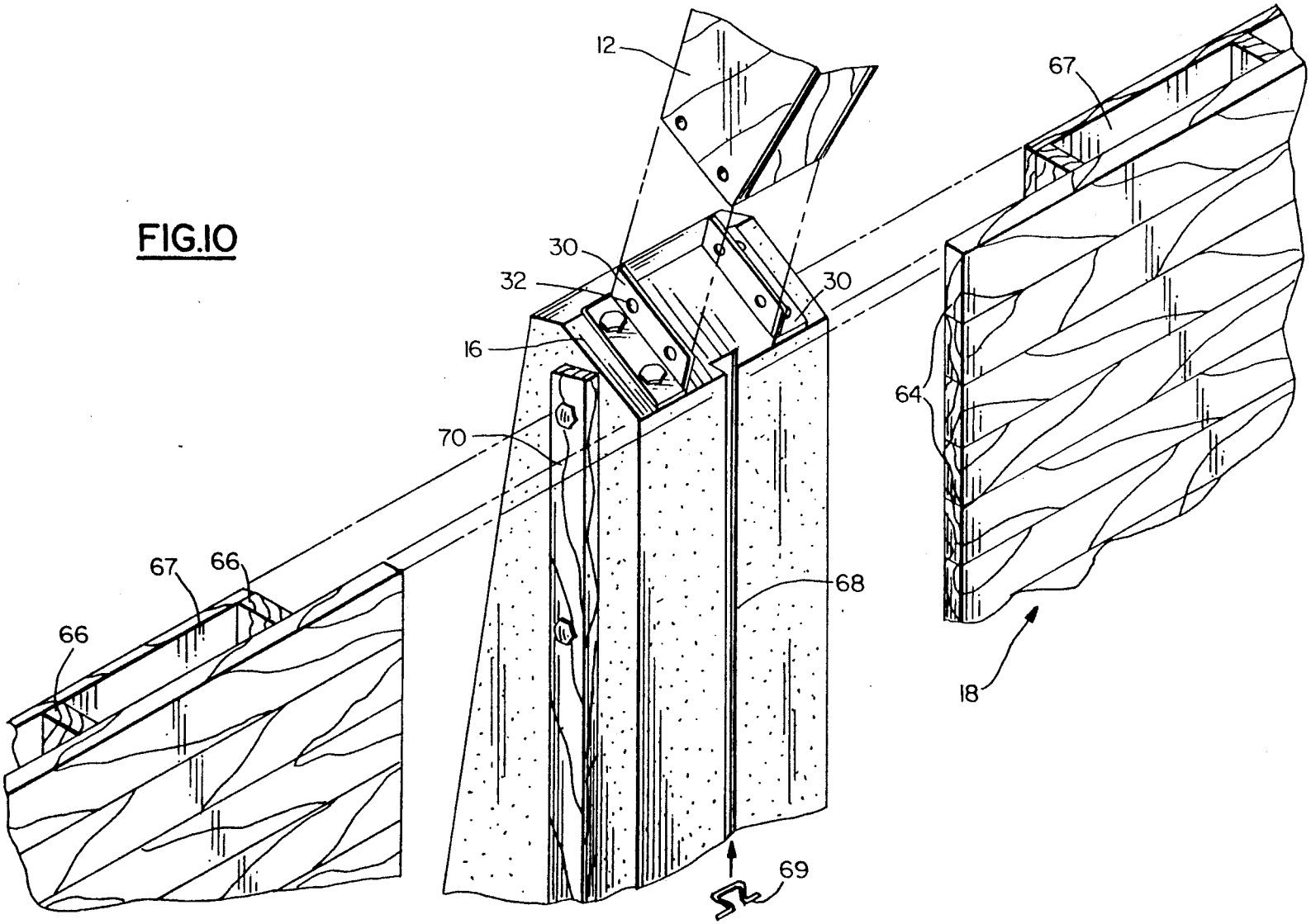
FIG. 10 is an exploded perspective view of barrier panels showing how they are mounted in abutting relationship on the inside of a pilaster.

Referring now to the drawings there is shown in FIG. 1 a partially erected building 10 containing a plurality of truss assemblies 12 embodying the teachings of the present invention. The building is specifically designed to store particulate material such as salt or sand of the type generally spread over icy road surfaces during the winter months to melt the ice and thus reduce driving risks. It should be apparent from the following description, however, that the building may be used for other purposes. The building includes a series of spaced apart raised concrete pilasters 14 that are poured into core holes formed in the ground. In this embodiment of the invention the pilasters are erected in a rectangular pattern which defines the perimeter of the building. The top surface of the pilasters are all formed to the same elevation so that they lie in a common plane. The tops of the pilasters have a slanted mounting plate surface 16 for receiving the lower end of the truss members 12 as will be described in more detail herein. A barrier wall 18 is formed on the inside of the pilasters 14 from the ground up to the top of the pilasters. The wall is preferably made of a series of panels of pressure treated beams and studs as shown in more detail in FIG. 10. The panels 20 are premanufactured in the factory and merely installed in place at the building site, all as will be described in detail herein.

Figure 3:
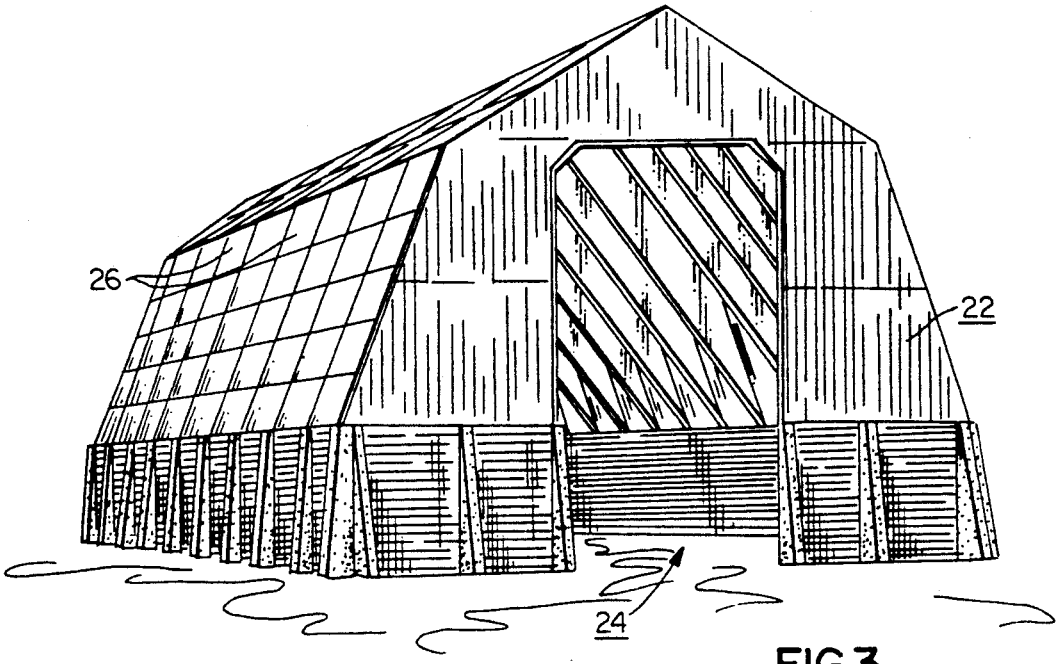
FIG. 3 is a further perspective view showing the front entrance to the building.
Figure 4:
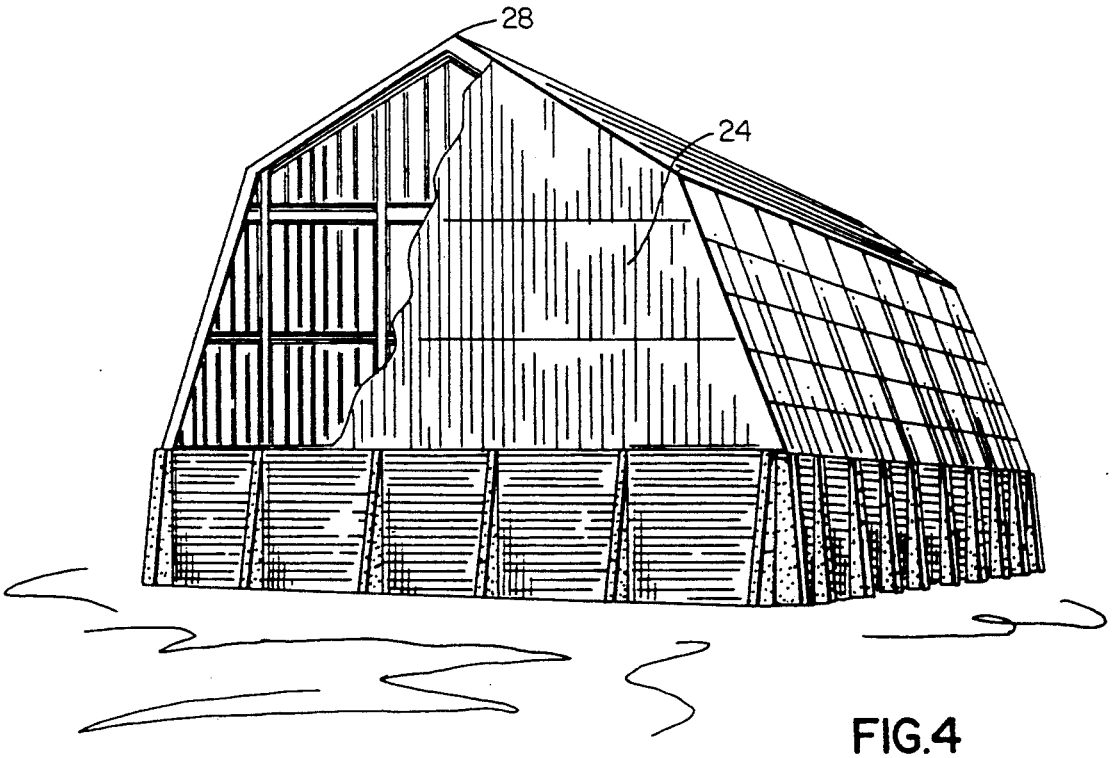
FIG. 4 is a perspective view showing the rear wall of the building.

As shown in FIGS. 3 and 4, the building is completed with vertical end walls 22 and 24. End wall 22 has a door opening and suitable doors, not shown, for closing the end if desired as is well known in the art. As may be clearly seen in FIGS. 3 and 4, the long side of the rectangular shape of the building consists essentially of roof panels 26 installed over the roof truss members 12, as will be described in detail herein, obviating the need for any wall facing material on the long sides.

Figure 2:
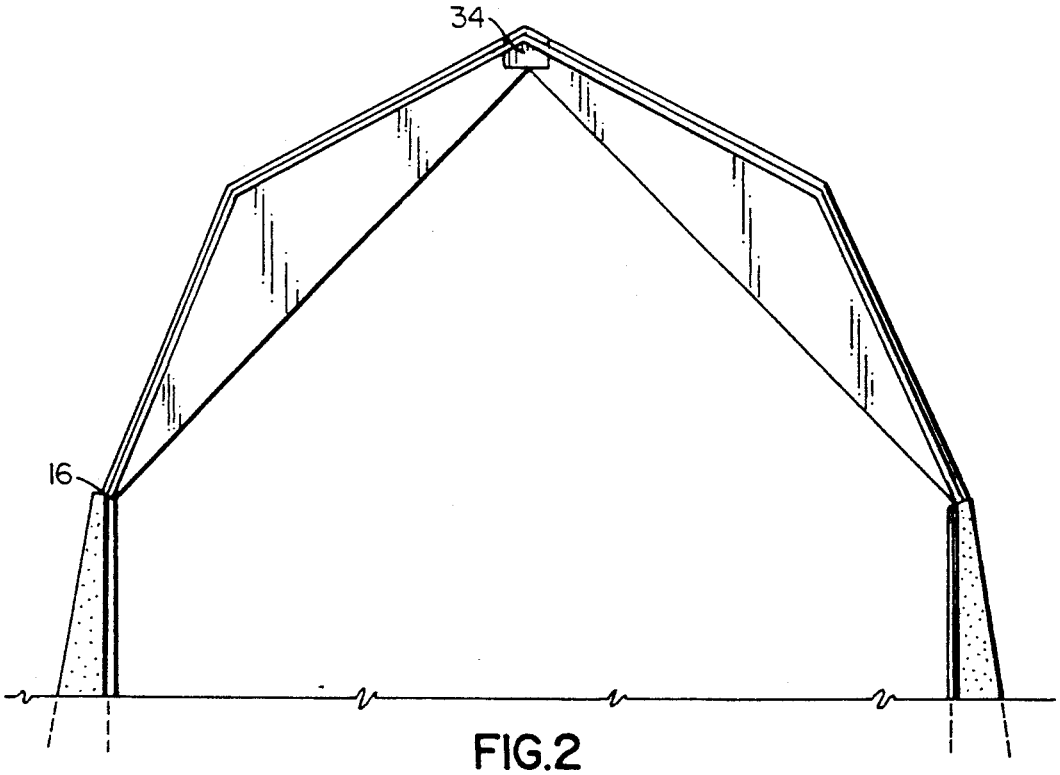
FIG. 2 is an enlarged sectional view of the building shown in FIG. 1 taken on line 2—2.

The roof truss members 12 are seated upon each of the concrete pilasters in the side rows and extend upwardly at an angle of approximately thirty two degrees to the horizontal. The truss members are arranged to come together in abutting contact at their crowns with the crowns describing the peak 28 of the building As can be clearly seen in FIGS. 1–4, the trusses 12 completely eliminate the need for any columns, purlins, horizontal beams or joists required in the more conventional buildings except for structure required in the vertical end walls. The trusses 12 also will eliminate any need for side wall facing materials since the entire outer surface of the trusses 12 is a roof surface and is covered with roof sheeting panels as will be described in more detail herein. As may be seen in FIG. 10, each roof truss 12 is secured at its base to a pilaster mounting face 16 which is disposed at an angle of approximately thirty two degrees to the horizontal by a pair of right angle plates 30 which are lag bolted to the concrete pilaster and have ears extending upwardly at right angles thereto. The ears have holes 32 therein through which bolts can be inserted through the base of the truss 12 to securely fix it to the pilaster. The upper crown ends of the trusses 12 are secured together by a ridge plate 34 which is through-bolted through the adjacent end plates of the mating trusses 12 to form a secure connection and joint. The plate 34 and the faces of the trusses can be glued with a waterproof glue suitable for such applications to securely hold the roof truss together as shown in FIGS. 1 and 2.

Referring now to FIGS. 5–8, each truss 12 comprises a linear inner chord member 36 which consists of two or more 2×8 or similar beams glued and fastened together to form the member 36 which becomes the inner chord or beam of the truss structure 12.

Figure 5:
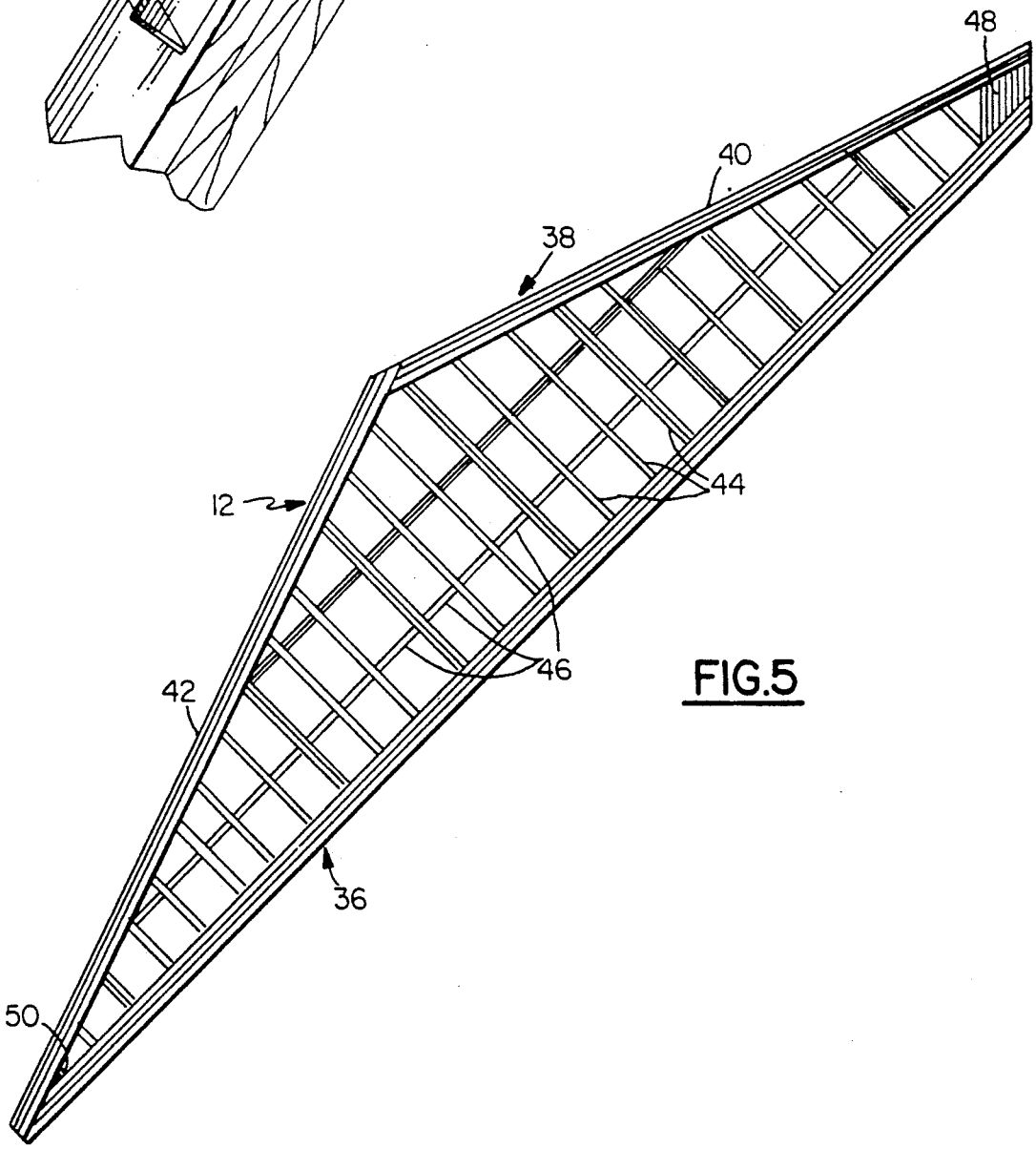
FIG. 5 is a side elevation of a truss member of the building of FIG. 1.
Figure 8:
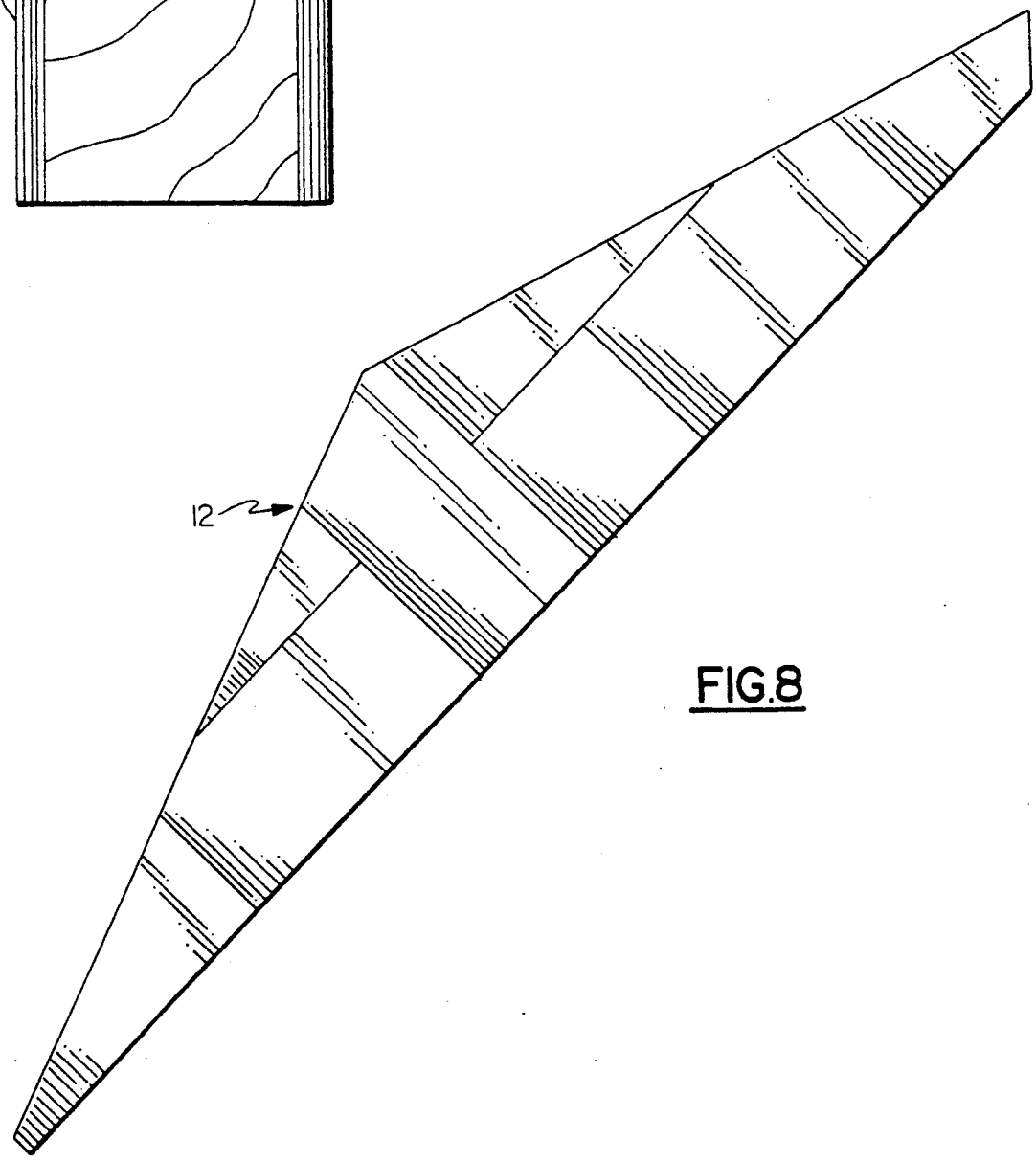
FIG. 8 is a view similar to FIG. 5 showing the cover sheeting in place on the truss member.

The outer chord 38 of the truss 12 takes the form of a triangular shaped beam which is formed from two frame members 40 and 42 each comprising two or more pieces of 2×8 lumber glued and fastened together to form the outer chord 38. The frame members extend from the ends of the inner chord 36 to a peak approximately at the center line of the chord 36. The two frame members 40 and 42 are glued and fastened together at the peak and are spaced apart from the inner chord 36 by studs 44 which are disposed perpendicularly to the inner chord 36 at spaced intervals along the inner chord 36. The studs 44 are bridged by bridging members 46, again at spaced intervals between the inner and outer chord members 36 and 38. The studs and bridging members 46 are chosen to be the same material as the chords so that the entire built-up truss can be covered with plywood sheeting to form an integral solid rigid truss unit when the covering sheets are installed, as will be described in connection with FIG. 8. The truss 12, as shown in FIG. 5 has at each end an end plate formed of three or four short pieces of lumber of the same size as used in the rest of the truss laminated together to form an end plate 48 at the upper end and similar smaller end plate 50 at the lower end. These end plates serve to reinforce and strengthen the end abutments of the truss 12 to permit secure fastening to the pilasters and to each other at the peak. After the structure shown in FIG. 5 is formed in the factory to the precise required dimensions, the structure is covered with sheets of plywood of an appropriate type which is both glued and nailed to the truss structural members, studs and bridging to form a solid integral unitized structure capable of withstanding extremely high external loads FIG. 8 shows a representative pattern of how half-inch CDX plywood would be applied to the truss of FIG. 5 utilizing standard 4×8 sheets so as to impart maximum strength and rigidity to the truss member 12. As can be seen in FIG. 5 at the junction of each sheet of plywood a second or third stud or bridge member is installed to strengthen the joint at the junction of the sheets and to provide adequate surface for gluing and fastening of the sheets as they abut each other on the sides of truss member 12.

Figure 6:
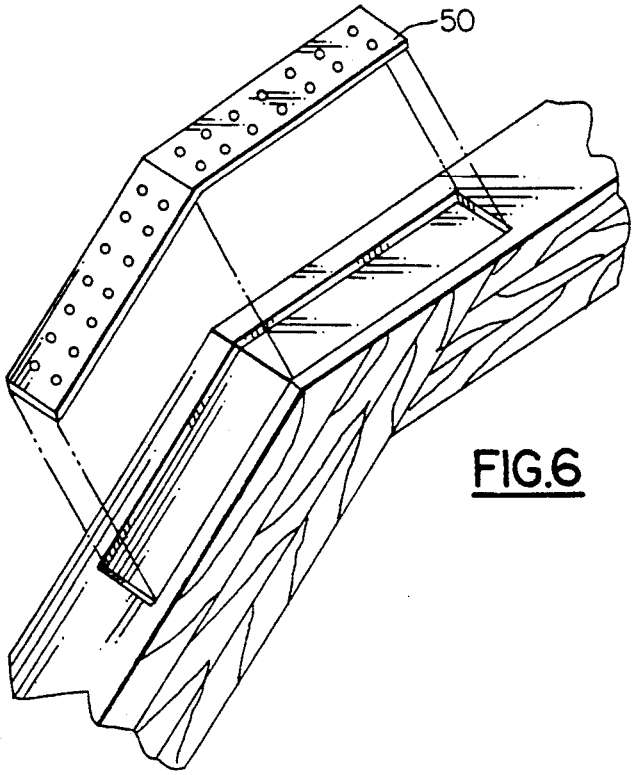
FIG. 6 is a partial perspective view of the tension plate at the apex of the triangular side of the truss member.

Finally, a tension plate 50 which is shown in FIG. 6 is secured to the apex of the triangular part of the truss 12 at the junction of the two members 40 and 42 of the outer chord 38. As seen in FIG. 6, the tension plate 50 is secured in place by nailing, lagging or wood screwing it to the adjacent outer chords of the truss 12 through holes 52 which are provided in the strap in correct quantities and sizes to provide adequate shear connections for the tension developed in this member by the truss 12. The precise tension in this member is determined by the span, height, dead loads, snow load and wind load expected on the roof structure and must be calculated to meet existing conditions of the location of each building.

Figure 7:
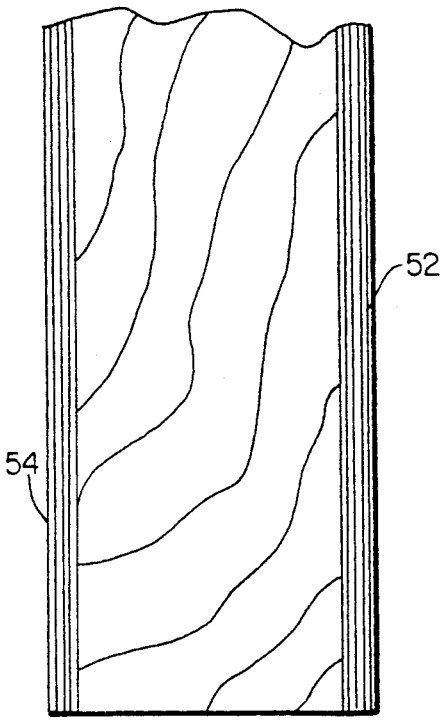
FIG. 7 is a partial sectional view taken on line 7—7 of FIG. 8.

After the two sides of the truss 12 have been covered with the plywood sheeting and the structure has been glued and fastened together, it becomes an integral unitized structure having very high strength to weight ratios and providing a factory manufactured truss that can be simply and easily raised in place on the site, without further assembly, and merely bolted together to similar additional trusses to form a roof structure. The lamination of the multi-ply plywood sheets 52 and 54 to the truss frame members is shown in FIGS. 7 and 8.

Figure 9:
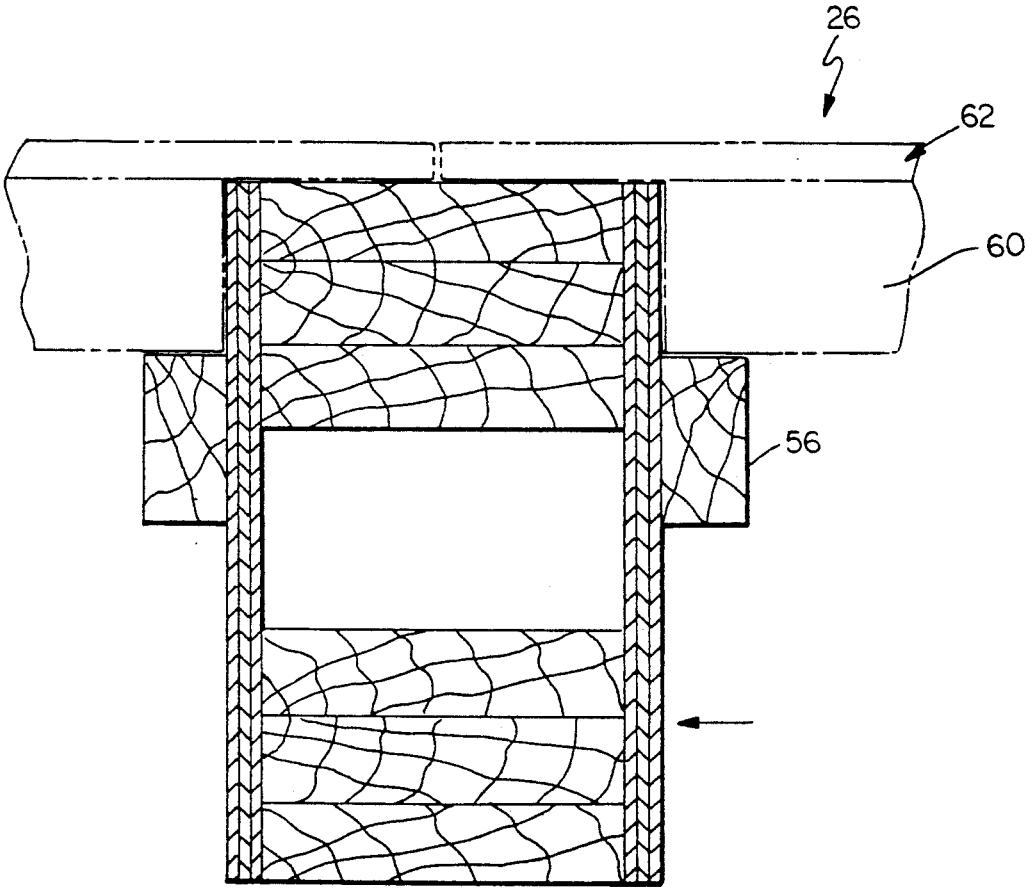
FIG. 9 is a partial cross sectional view of roof panels abutting about a roof truss member.

Referring now to FIG. 9, each truss member has secured to it adjacent its outer edge ledger strips 56 which form a seat and a support for roof panels 26 which are constructed so as to fit between adjacent truss members 12 and to rest on the ledger strips 56. Roof panels 26 comprise a frame work of stringers 60 and studs (not shown) covered on the outer surface by plywood or other sheathing 62. The stringers 60 span the distance between adjacent truss members resting on the seats formed by the ledger strips 56. The outer sheathing 62 of the panels 26 is formed so as to overlap the top of the outer chord of the roof trusses 12 to form a tight sealed connection not only with the truss, but with each other upon application of suitable glue and sealants at the intersection thereof.

Roof panels 26 are mounted between adjacent truss members 12 and extend from adjacent the top of the pilasters and barrier wall up to the peak of the building roof to securely seal the building from the weather.

Once the roof is completed, the end walls of the structure can be built with framing and side panels which can be similar to the roof panels, if desired Other types of side panels can also be used to fully enclose the building formed on top of the barrier walls fixed to the pilasters. Referring again to FIG. 10, the barrier wall 18 of the structure of FIGS. 1–4 is in a preferred embodiment formed from panels 18 of heavy longitudinal timbers 64, secured to studs 66 at spaced intervals along the back with the studs 66 being fastened to strin9ers 67 spaced at the appropriate distance to fit between two adjacent pilasters. The plank 64 are sized so as to extend over past the end of the stud adjacent the pilaster and to extend over the face of the pilaster and abut the next adjacent panel when installed between adjacent pilasters. The panels 18, in addition to being secured to the pilaster by clips 69 placed in a dovetail groove 68 formed in the pilaster when it is poured, rests on ledger strips 70 which are lag bolted to the sides of the Pilaster and spaced from the inside surface of the pilaster a distance appropriate to receive thereon the panel 18 when positioned between adjacent pilasters. The panels 18 extend from the ground level up to the top of the pilasters 14 and are made of a treated lumber so as to be able to withstand the moisture and other adverse environmental conditions encountered in storing sand, salt, and similar particulate marerial.

Since the barrier wall panels are placed on the inside of the pilasters and extend only to the upper edge surface on which are mounted the trusses and s ince the roof panels 26 extend downwardly from the trusses to the top of the pilasters, there is plenty of air space between the inner and outer surfaces to allow circulation of ventilating air for the structure. If desired, suitable closure members can be inserted in here to completely seal the building from the outdoor elements As seen in FIGS. 3 and 4, the front and rear walls of the rectangular building structure are covered with similar sheeting units 26 to the roof panels used on the roof but sized specifically to fit within the framework of the end walls 22 and 24. The front and rear walls include additional pilasters for securing the barrier wall and for providing a door structure when desired in the front end of the building. The doorway is formed by a pair of vertical beams anchored at the top by a cross-beam and secured to the top of the supporting pilasters adjacent the doorway in a manner similar to the way the truss members are secured to the pilasters. The back wall of the building includes sufficient pilasters to extend the barrier wall completely across the end thereof and to support the closure of the end of the building as shown in FIG. 4.

Referring now to FIGS. 11–14 there is shown another embodiment of the present invention. In FIG. 11 a generally circular structure 100 is built in accordance with the teachings of the present invention in which a plurality of pilasters 104 are secured in the ground similarly to the pilasters 14 but spaced in a circular pattern along the circumference of a common circle. The wooden truss members 102 then are mounted on each pilaster and extend upwardly toward the corresponding pilaster on the other side of the circle, but instead of abutting each other, they are joined together at a crown compression block 110 which has a suitable number of attaching faces so thar each truss member mounted on a pilaster can be joined together to form the complete circular structure. Each roof truss member 102 extends from the bottom where it is secured to the pilaster similarly to the way the trusses 12 are secured in FIG. 12 and the upper end is as indicated, fastened to the compression block 110 which positions the truss members 102 in the appropriate angular relationship so as to be fully supported by the pilasters 102 on opposite sides of the circle and to form a fully enclosing roof frame structure.

Again, as in FIGS. 1–4 suitable barrier wall panels 108 are provided on the inside of adjacent pilasters and suitable roof panels 106 are mounted between adjacent truss members. As will be seen in FIG. 11, the roof panels, of course must be tapered to reflect the tapered circular configuration of the building as they are positioned from the pilasters toward the peak of building. An entranceway 112 is provided berween adjacent pilasters. The entranceway can be left open between the pilasters or it can be enclosed with the vertical wall sections being disposed either on the interior or exterior of the entranceway with suitable siding closures to complete the building, as is well known in the conical building art.

Figure 13:
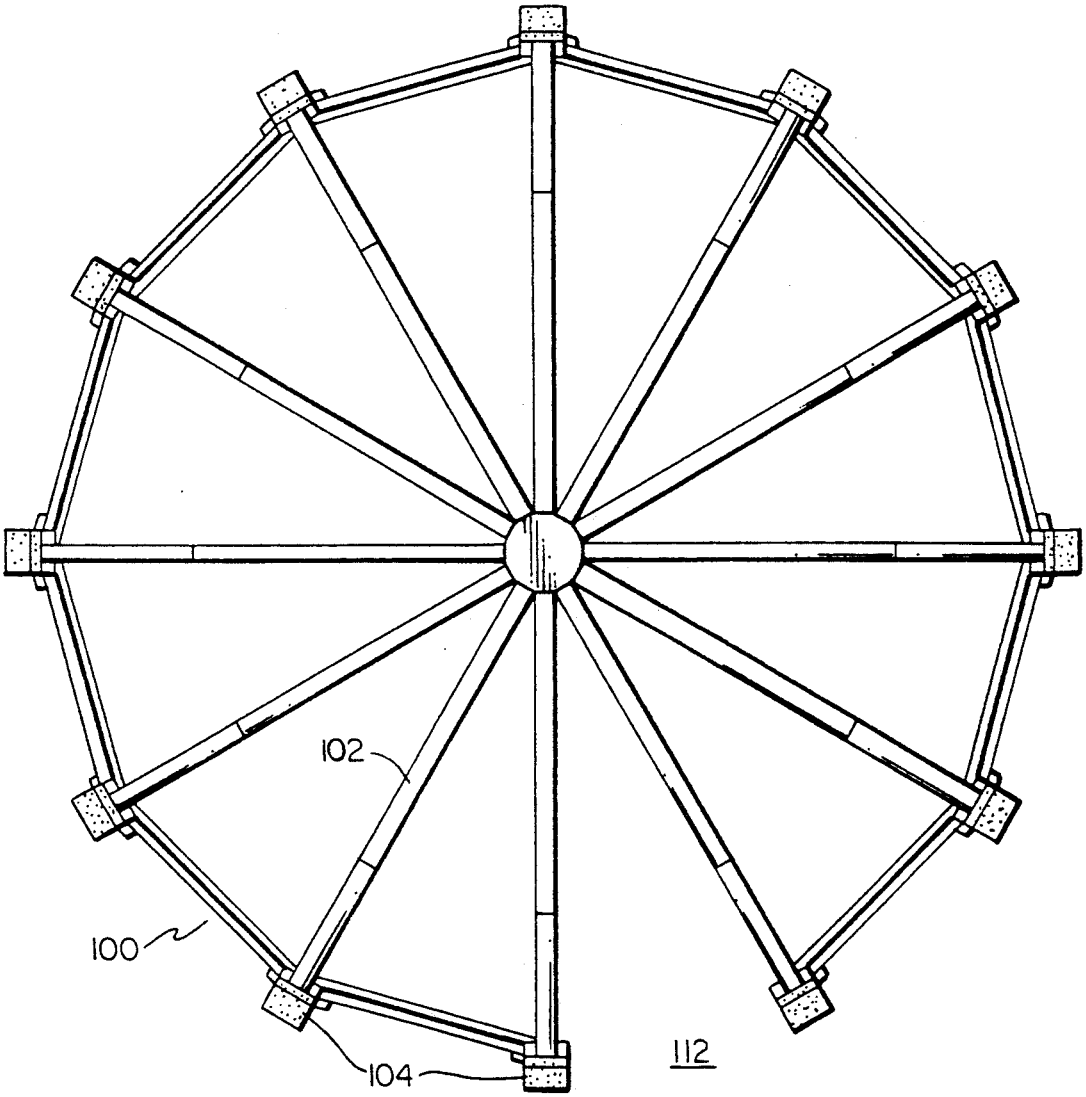
FIG. 13 is a top plan view of the structure of FIG. 11 before installation of roof panels.
Figure 14:
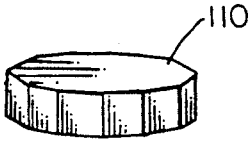
FIG. 14 is a perspective view of the compression crown member of FIG. 13.

As shown in FIG. 13, the building is constructed with a series of twelve pilasters and truss sections joined together at the crown compression block 110, although other configurations obviously can be used, depending on the particular requirements of the building and the load conditions encountered in the particular area in which the building is to be constructed.

While this invention has been explained with reference to the structure disclosed herein, it is not confined to the details set forth and this application is intended to cover any modifications and changes as may come within the scope of the following claims:

What is claimed is:

1. A building for housing particulate material which comprises:

a plurality of equally spaced pilasters secured in the ground, each pilaster having its upper end in a common plane with the others;

a barrier wall attached to adjacent pilasters secured in the ground, each pilaster having its upper end in a common plane with the others;

a barrier wall attached to adjacent pilasters, said barrier wall extending upwardly from the ground to the top of the pilasters;

a corresponding plurality of wooden roof truss members mounted, at the lower end, on the top of each pilaster and attached at their crown to at least one other truss;

each of said truss members comprising:

an upper end plate;

a lower end plate;

an inner linear chord member extending from said lower end plate to said upper end plate;

an outer chord member extending from said lower end plate to said upper end plate;

said outer chord member having aupper and lower chord sections each set at one end at diverging angle to said inner chord member and joined together at the other end to form a generally triangular shape;

a plurality of studs extending from said inner chord member to said upper and lower chord sections at spaced intervals therealong mounted perpendicular to said inner chord member;

a plurality of bridging members mounted between said studs at spaced intervals from and parallel to said inner chord member;

a plurality of plywood cover panels fastened to said chords, studs and bridging member on both sides thereof to enclose and stiffen said members to form an integral rigid beam truss member;

so that said pair of identical roof truss members form a roof frame structure awithout further bracing or truss members; and cover sheeting meabns secured to the upper surface of the outer chord portions of the roof truss members to form a roof sheathing enclosing the building.

2. A building for housing particulate material according to claim 1 further including:

said plurality of equally spaced pilasters being secured in the ground about the circumference of a circle;

a crown compression block having a plurality of truss attaching faces corresponding to said plurality of pilasters; and said corresponding plurality of wooden roof truss members mounted at the lower end on each pilaster having the upper end of each truss member secured to said crown compression block at the corresponding attaching face.

3. A wooden roof truss member for forming with an identical second roof truss member a roof frame structure by mounting the bottom end of each truss on spaced apart pilasters and joining the upper end of each truss together to form a roof peak which comprises:

an upper end plate;

a lower end plate;

an inner linear chord member extending from said lower end plate to said upper end plate;

an outer chord member extending from said lower end plate to said upper end plate;

said outer chord member having upper and lower chord sections each set at one end at a diverging angle to said inner chord member and joined together at the other end to form a generally triangular shape;

a plurality of studs extending from said inner chord member to said upper and lower chord sections at spaced intervals therealong mounted perpendicular to said inner chord member;

a plurality of bridging members mounted between said studs at spaced intervals from and parallel to said inner chord member;

a plurality of plywood cover panels fastened to said chord members, studs and bridging members on both sides thereof to enclose and stiffen said members to form an integral rigid beam truss member;

so that a pair of identical roof truss members form a roof frame structure without further bracing or truss members.

4. A wooden roof truss member according to claim 3 further including a metal tension platre fastened to said outer chord member to span the junction of the outer chord sections.

5. A wooden roof truss member according to claim 3 further including ledge strips bonded on either side of said roof truss outer chord member a predetermined distance from the top surface to form a seat for receiving roof sheathing panels between adjacent trusses when installed on spaced apart pilasters.

6. A building for housing particulate material which comprises:

a plurality of equally spaced pilasters secured in the ground about the circumference of a circle, each pilaster having its upper end in a common plane with the others;

a crown compression block having a plurality of truss attaching faces corresponding to said plurality of pilasters; and a barrier wall attached to adjacent pilasters, said barrier wall extending upwardly from the ground to the top of the pilasters;

a corresponding plurality of wooden roof truss members having a base plate and a crown end plate mounted, at the lower base end, on the top of each pilaster and attached at their crown end to said compression block at the corresponding attaching face;

each of said roof truss members having a straight inner chord portion and a triangular outer chord portion joined together with studs, bridging and sheeting means to form a rigid roof truss; and said pilasters have a truss attaching face disposed at 58 degrees from the horizontal and the lower base plate of said truss members is perpendicular to the inner chord portion so that the inner chord portion fo the roof truss forms an angle of =degrees with the horizontal when a truss member is mounted on a pilaster.

7. A building according to claim 6 wherein the upper end face of the crown of the roof truss member is vertical and the mating attaching faces of the crown compression block are vertical.

8. A building for housing particulate material which comprises:

a plurality of equally spaced pilasters secured in the ground, each pilaster having its upper end in a common plane with the others;

a barrier wall attached to adjacent pilasters, said barrier wall extending upwardly from the ground to the top of the pilasters;

a corresponding plurality of wooden roof truss members mounted, at the lower end, on the top of each pilaster and attached at their crown to at leat one other truss;

each of said roof truss members having a straight inner chord portion and a triangular outer chord portion joined together with studs, bridging and sheeting means to form a rigid roof truss; and cover sheeting means secured to the upper surface of the outer chord portions of the roof truss members to form a roof sheathing enclosing the building said barrier wall is formed of prefabricated horizontally disposed panels extending laterally from center line to center line of adjacent pilasters; and said prefabricated panels comprise a plurality of horizontal planks having a length equal to the spacing of said pilasters and a plurality of spaced apart struds and stringers, said planks being fixed to said studs in abutting edge to edge relationship.

9. The building according to claim 8 further including ledger strips mounted a predetermined distance back from the face of the pilasters on either side of said pilaters to form a seat on which is received said horizontally disposed panels with the ends of said planks covering the inside face of the pilasters.

10. The building according to claim 9 further including a vertical dovetail slot formed on the centerline of the pilasters and anchor clip means positioned in said dovetail slots to secure the ends of said horizontal planks to said pilasters.

* * * * *

UNITED STATES PATENT AND TRADEMARK OFFICE

CERTIFICATE OF CORRECTION

PATENT NO. : 5,159,792

DATED : November 3, 1992

INVENTOR(S) : Patrick G. Pomento

It is certified that error appears in the above—identified patent and that said Letters Patent is hereby corrected as shown below:

Col. 6, please delete lines 40-42;

line 57, please delete "aupper" and insert --upper--;

line 58, after the second occurrence of "at", please delete --a--.

Col. 7, line 6, please delete "awithout" and insert --without--;

line 8, please delete "meabns" and insert --means--;

line 60, please delete "ledge" and insert --ledger--.

Col. 8, line 23, please delete "fo" and insert --of--;

please delete "=";

line 40, please delete "leat" and insert --least--;

line 55, please delete "struds" and insert --studs--;

UNITED STATES PATENT AND TRADEMARK OFFICE

CERTIFICATE OF CORRECTION

PATENT NO. : 5,159,792

DATED : November 3, 1992

INVENTOR(S) : Patrick G. Pomento

It is certified that error appears in the above-identified patent and that said Letters Patent is hereby corrected as shown below:

lines 59 and 60, please delete "pilat-ers" and insert --pilast-ers--.

Signed and Sealed this

Twelfth Day of October, 1993

*Attest:*

Bruce Lehman

BRUCE LEHMAN

*Attesting Officer*

*Commissioner of Patents and Trademarks*